US005088905A

United States Patent [19]

Beagle

[11] Patent Number: 5,088,905

[45] Date of Patent: Feb. 18, 1992

[54] CHECK VALVE FOR SCROLL COMPRESSOR

[75] Inventor: Wayne P. Beagle, Kirkville, N.Y.

[73] Assignee: Carrier Corporation, Syracuse, N.Y.

[21] Appl. No.: 588,778

[22] Filed: Sep. 27, 1990

[51] Int. Cl.[5] ..... F04C 18/04; F16K 15/03

[52] U.S. Cl. ..... 418/55.1; 418/270; 137/521; 137/527.8

[58] Field of Search ..... 418/55.1, 270; 137/521, 137/527.8

[56] References Cited

U.S. PATENT DOCUMENTS

| | | | |
|---|---|---|---|
| 2,923,317 | 2/1960 | McInerney | 137/521 |
| 4,325,660 | 4/1982 | Jones | 137/521 |
| 4,759,696 | 7/1988 | Ishiai | 418/55.1 |

FOREIGN PATENT DOCUMENTS 1-130082 5/1989 Japan .

*Primary Examiner*—John J. Vrablik

[57] ABSTRACT

A low side scroll compressor is provided with a pivoted bistable check valve. In the open position the valve is out of the direct discharge from the scrolls but in close proximity to the discharge tube such that upon stopping the compressor the reverse flow from the system impinges upon the valve member causing it to close.

6 Claims, 2 Drawing Sheets

CHECK VALVE FOR SCROLL COMPRESSOR

BACKGROUND OF THE INVENTION

Hermetic scroll compressors require a check valve located in the discharge passage to prevent the compressor from running as an expander due to the reversed pressure differential upon stopping. However, the check valves are pressure sensitive and move, as by spring bias, with changes in pressure during compressor operation and thereby produce valve contact and resulting noise.

SUMMARY OF THE INVENTION

A scroll compressor is provided with a check valve assembly which is located in the direct discharge passage. The check valve is used to prevent reverse rotation of the scroll wraps due to the reversed pressure differential upon stopping the compressor.

It is an object of this invention to provide a single assembly incorporating a separator plate and check valve.

A further object of this invention is to provide a quieter check valve for a scroll compressor.

It is another object of this invention to locate the check valve close to the discharge port to enhance the reverse rotation prevention.

These objects, and others as will become apparent hereinafter, are accomplished by the present invention.

Basically, the shell of a hermetic compressor is divided into a suction plenum and a discharge plenum by a separator plate. The separator plate carries a check valve assembly. The check valve is bistable and is opened by fluid pressure, upon the compressor startup, and closed by fluid flow, upon the compressor stopping, while being stable and quiet in the open position during compressor operation.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
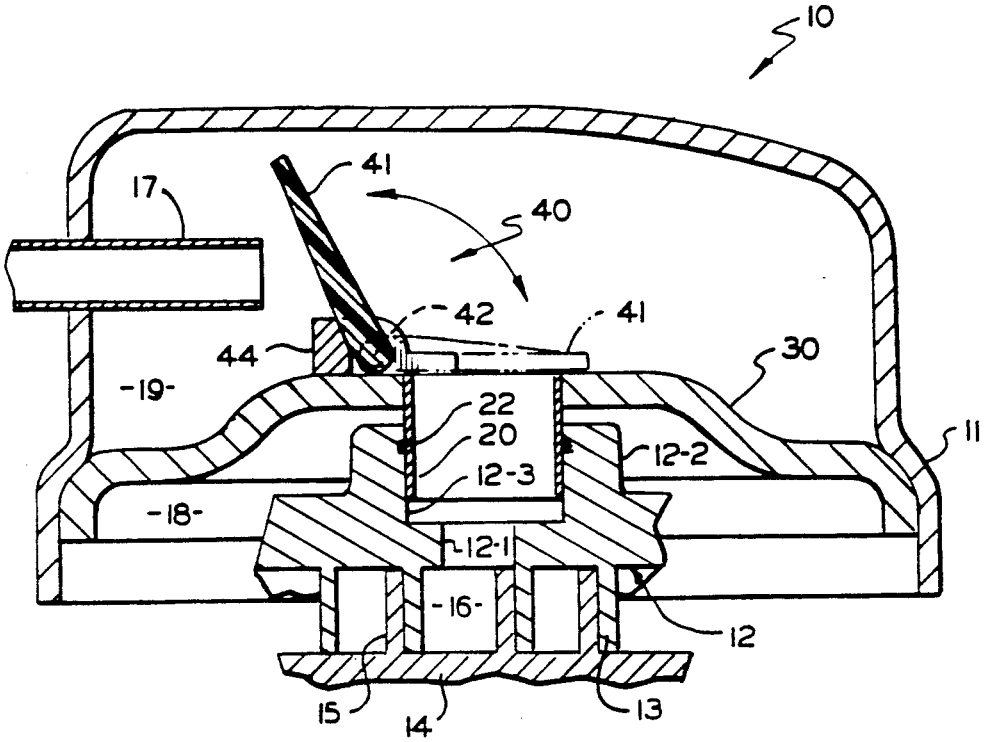
FIG. 1 is a partial cutaway sectional view of a portion of a low side hermetic scroll compressor employing the present invention.

In FIG. 1, the numeral 10 generally designates a low side hermetic scroll compressor having a shell or casing 11. A low side hermetic compressor is one in which all or most of the shell or casing is at suction pressure. A fixed scroll 12 having a wrap 13 and an orbiting scroll 14 having a wrap 15 are located in shell or casing 11 in any suitable manner. A generally axial discharge port 12-1 is formed in fixed scroll 12. The side of fixed scroll 12 opposite wrap 13 and through which discharge port 12-1 extends includes a raised central cylindrical portion 12-2 defining counter bore 12-3 which receives sleeve 20. Sleeve 20 is sealed with bore 12-3 by suitable seal 22 and is welded or otherwise suitably sealingly secured to separator plate 30. With separator plate 30 sealed to casing 11 and to fixed scroll 12 via sleeve 20 and seal 22, the interior of casing 11 is divided into a suction plenum 18 and a discharge plenum 19.

Figure 3:
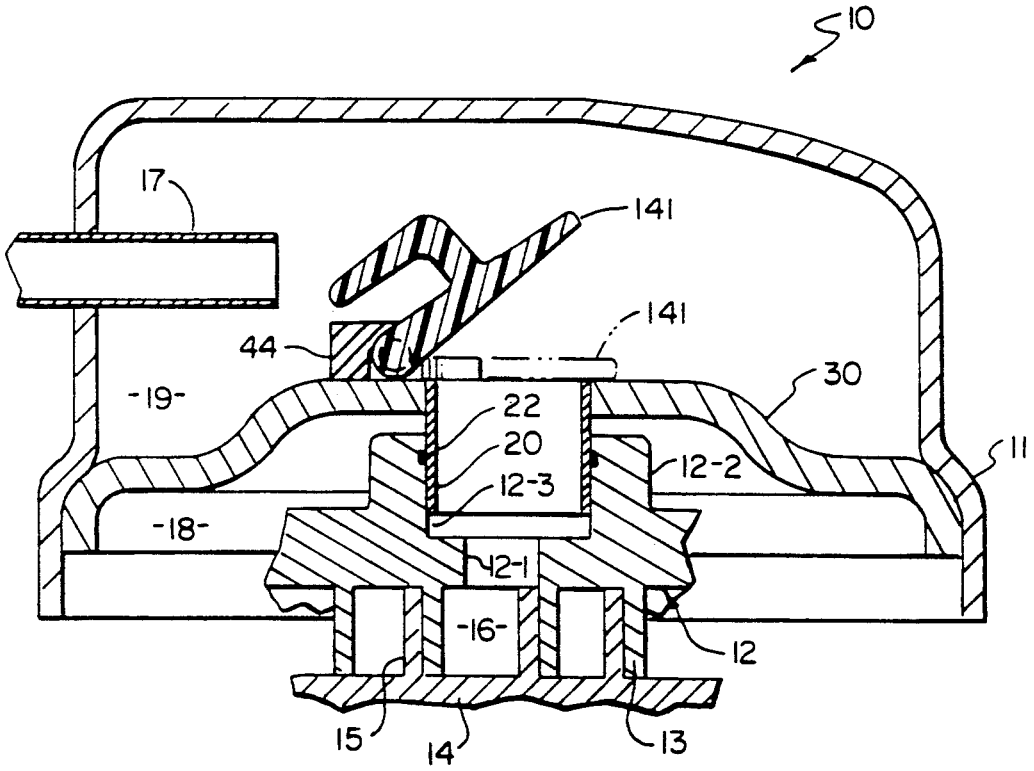
FIG. 3 shows a modification of the valve member.

Valve member 41 of check valve assembly 40 is freely pivotably secured via integral pin portion 42 which is received in hinge slots 43 (only one of which is shown) in support 44 which is screwed by screws 46, as illustrated, or welded or otherwise suitably secured to separator plate 30. Valve member 41 is in its open position and, as indicated by the phantom showing of its closed position, valve member 41 has a range of movement well in excess of 90° with a 120° range of movement illustrated. Movement is between the seating of valve member 41 on plate 30 and the engagement of valve member 41 with the valve stop 45 formed on support 44. As a result, at the two extremes of movement, the center of gravity of valve member 41 is on opposite sides of pin 42 and is therefore stable in each position. A typical range of movement between stable positions is from 90° to 135°. The range of movement can be changed, however, by changing the location of the center of gravity to increase or decrease the range of movement to achieve a stable open position e.g. less than 90° as shown by valve member 141 in FIG. 3. Valve member 41 is made of a suitable light weight and durable material such as plastic.

Figure 2:
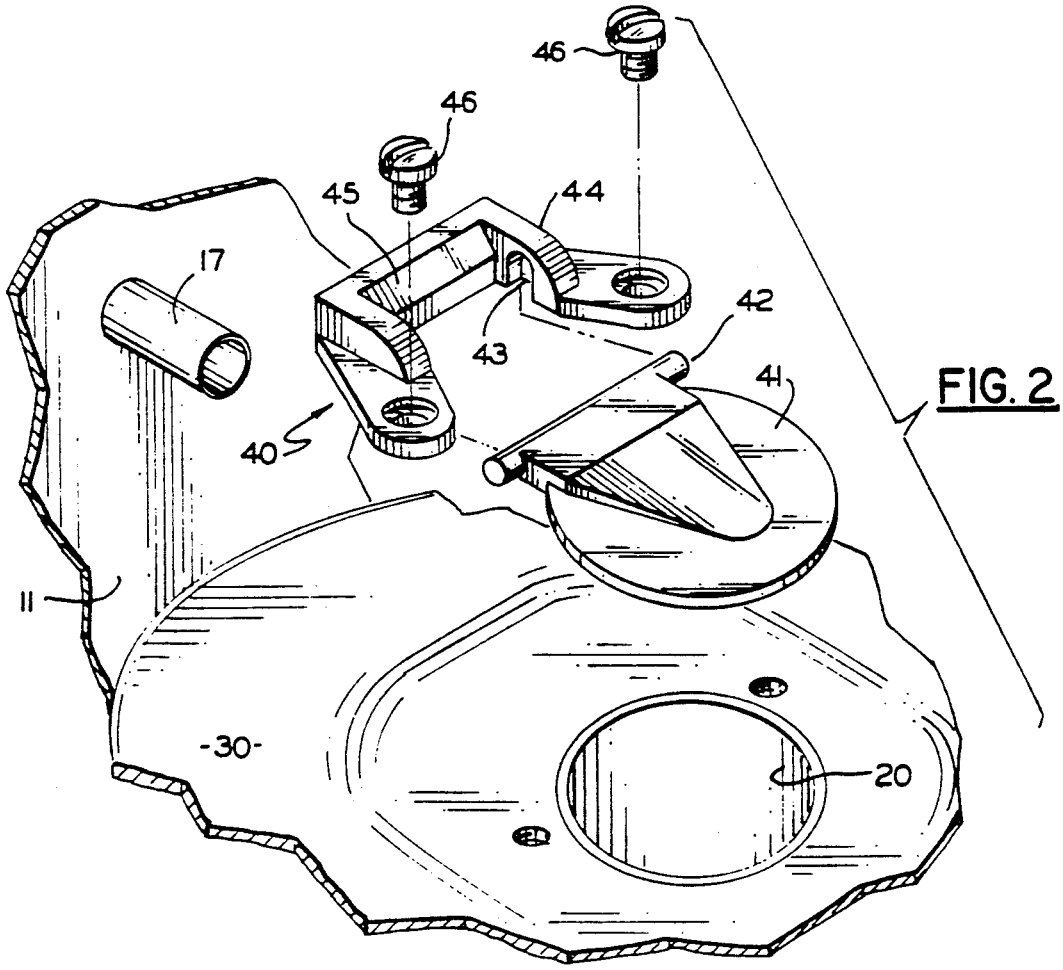
FIG. 2 is an exploded perspective view of the present invention.

In operation, high pressure gas compressed by the motion of orbiting scroll 14 relative to fixed scroll 12 exits the compression chamber 16 serially through discharge port 12-1 bore 12-3 and sleeve 20 by lifting valve member 41 which freely pivots downstream from the dotted line position of FIG. 1 to the solid line position where valve member 41 engages stop 45 such that the top of valve member 41 faces discharge tube 17. Thus, in the illustrated open position of valve assembly 40, valve member 41 moves out of the direct path of the discharge pulsations leaving fixed scroll discharge port 12-1. Further, the center of gravity of valve member 41 is on the discharge tube side of pin 42 and is thus stably located in the open position and valve member 41 remains motionless and does not create noise during normal operation of scroll compressor 10. As clearly shown in FIGS. 1 and 2, discharge tube 17 is extended into shell 11 to a location such that the top of valve member 41 is in close proximity to discharge tube 17 when valve member 41 is in its open position. As a result, when compressor 10 is stopped compressed refrigerant in the system (not illustrated) tends to return to discharge plenum 19 via discharge tube 17. However, the gas returning via discharge tube 17 impinges upon the top of valve member 41 forcing valve member 41 to quickly close to prevent reverse flow through the compressor. Because the center of gravity of valve member 41 moves to the other side of pin 42 upon closure, valve member 41 is stable in the closed position.

Although a preferred embodiment of the present invention has been illustrated and described, other modifications will occur to those skilled in the art. For example, the center of gravity of valve member 41 can be adjusted as through a portion extending below valve member 41 into tube 20 or above valve member 41 to change the degree of opening required to achieve a stable open position so long as closure will occur upon reverse flow. Also, the portion of the valve member impinged upon by the reverse flow may be configured for a more efficient coaction. It is therefore intended that the present invention is to be limited only by the scope of the appended claims.

What is claimed is:

1. In a hermetic scroll compressor having a discharge plenum fluidly connected to a discharge port and a discharge tube, a check valve assembly comprising:

support means fixedly located in said discharge plenum;

valve means freely pivotably mounted in said support means so as to be movable over a range of 90° to 135° between two stable positrons due solely to gravity corresponding to a first extreme position blocking said discharge port and a second extreme position in proximity to said discharge tube whereby refrigerant discharged from said discharge port moves said valve means from said first to said second position and when said compressor is stopped, refrigerant entering said discharge plenum from said discharge tube impinges on said valve means and causes said valve means to move from said second to said first position thereby blocking said discharge port.

2. The check valve assembly of claim 1 wherein said valve means is in a generally horizontal orientation when in said first position.

3. In a hermetic compressor having a shell and a separator plate in said shell for dividing said shell into a suction plenum and a discharge plenum, discharge port means fluidly connected to said discharge plenum through said separator plate, a discharge tube extending through said shell into said discharge plenum for supplying compressed refrigerant from said discharge plenum to a refrigerant system, a check valve assembly comprising:

support means located in said discharge plenum and fixedly secured to said separator plate intermediate said discharge port means and said discharge tube;

valve means freely pivotably mounted in said support means so as to be movable between a first stable position blocking said discharge port means and a second stable position in proximity to said discharge tube, said stable positions being due solely to gravity, whereby refrigerant discharged through said discharge port moves said valve means from said first to said second stable position and when said compressor is stopped, a reverse flow of refrigerant entering said discharge plenum from said discharge tube impinges on said valve means and causes said valve means to move from said second to said first position thereby blocking said discharge port means.

4. The check valve assembly of claim 3 wherein said first and second stable positions are 90° to 135° apart.

5. The check valve assembly of claim 3 wherein said valve means is in a generally horizontal orientation when in said first position.

6. The check valve assembly of claim 3 wherein said compressor means is a vertical scroll compressor.

* * * * *

UNITED STATES PATENT AND TRADEMARK OFFICE

CERTIFICATE OF CORRECTION

PATENT NO. : 5,088,905

DATED : February 18, 1992

INVENTOR(S) : WAYNE P. BEAGLE

It is certified that error appears in the above-identified patent and that said Letters Patent is hereby corrected as shown below:

Col. 3,

In claim 1 at line 8 change "positrons" to --positions--.

Col. 4,

In claim 3 at line 19 after "port" and before "moves" insert -- means--.

Signed and Sealed this

Thirteenth Day of July, 1993

*Attest:*

Michael K. Kirk

MICHAEL K. KIRK

*Attesting Officer*

*Acting Commissioner of Patents and Trademarks*